United States Patent [19]

Corey

[11] Patent Number: 4,869,613

[45] Date of Patent: Sep. 26, 1989

[54] COMBINED SHEET COMPRESSOR AND TRANSFER DEVICE FOR ATTACHMENT TO SPACED PRONGS OF A FILE FOLDER FASTENER

[75] Inventor: Thomas J. Corey, Buffalo, N.Y.

[73] Assignee: Permclip Products Corporation, Buffalo, N.Y.

[21] Appl. No.: 104,242

[22] Filed: Oct. 5, 1987

[51] Int. Cl.[4] ..... B42F 13/42

[52] U.S. Cl. ..... 402/7; 402/13; 402/8; 402/60; 402/80 R

[58] Field of Search ..... 402/7, 14, 15, 16, 17, 402/18, 75, 13, 8, 68

[56] References Cited

U.S. PATENT DOCUMENTS

| | | | |
|---|---|---|---|
| 3,503,695 | 3/1970 | Giampa | 402/68 X |
| 4,084,911 | 4/1978 | DeWitt | 402/15 |
| 4,269,530 | 5/1981 | Weber | 402/80 R X |
| 4,519,504 | 5/1985 | Nausedas | 402/13 X |
| 4,632,586 | 12/1986 | Erickson | 402/80 R X |

FOREIGN PATENT DOCUMENTS

| | | | |
|---|---|---|---|
| 673587 | 1/1930 | France | 402/60 |
| 862775 | 3/1961 | United Kingdom . | |
| 2114059 | 8/1983 | United Kingdom | 402/8 |

OTHER PUBLICATIONS

Two Photographs.

*Primary Examiner*—Paul A. Bell
*Attorney, Agent, or Firm*—Joseph P. Gastel

[57] ABSTRACT

A combined sheet compressor and transfer device for attachment to spaced prongs of a file folder fastener including a plate-like cross member for receiving the prongs of the file folder fastener and bearing against a stack of sheets to thereby act as a compressor, a pair of substantially parallel flexible elongated legs of substantially rectangular cross section extending from the plate-like cross member, and flexible tubular members at the outer ends of the legs of a slightly smaller internal diameter than the width of the prongs so as to be distorted at their outer ends when mounted on the prongs to thus provide a relatively smooth junction therewith at their outer ends to facilitate the transfer of sheets from the prongs onto the legs when functioning as a transfer device, diametrically opposed reinforcement bosses on opposite sides of the tubular members for overlying the edges of the prongs to thereby prevent the edges of the prongs from cutting the tubular members, and a tapered portion between the junctions of the legs and the tubular members for providing a smooth transition therebetween to facilitate the transfer of sheets from the legs onto the prongs.

44 Claims, 3 Drawing Sheets

Fig. 10.
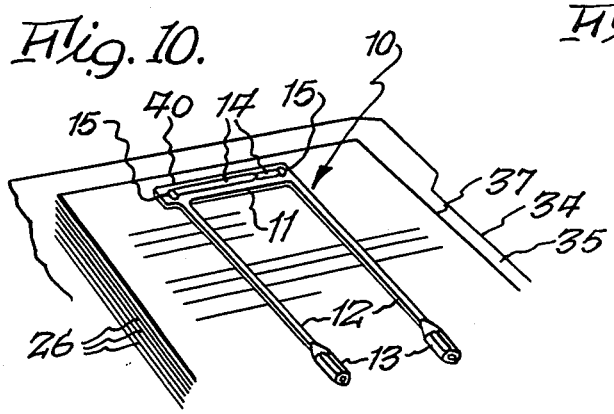
Fig. 14.
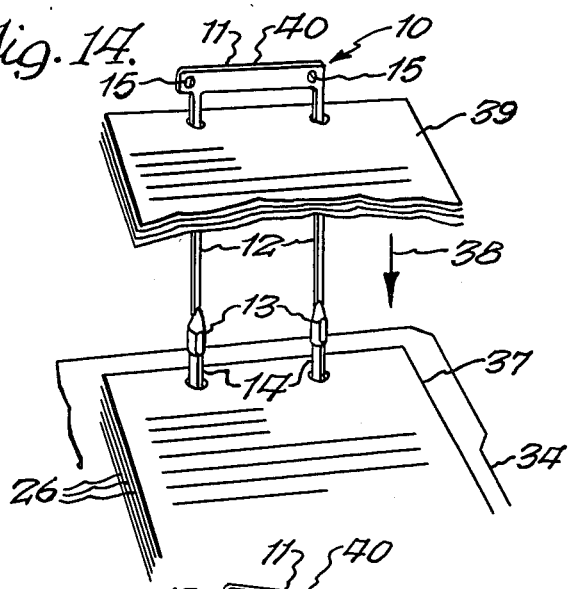
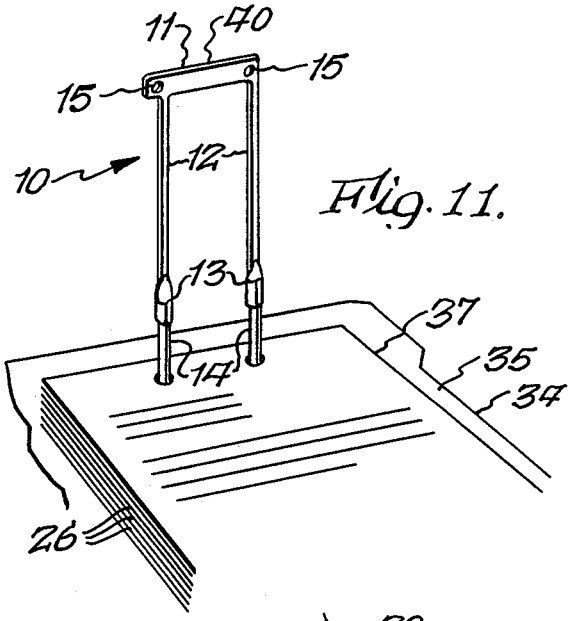
Fig. 11.
Fig. 15.
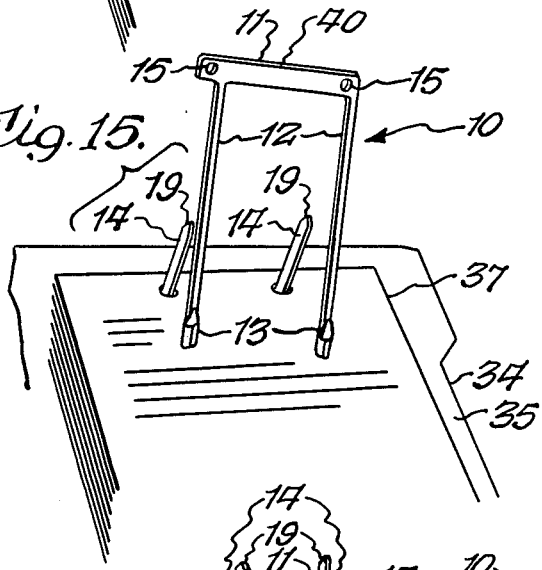
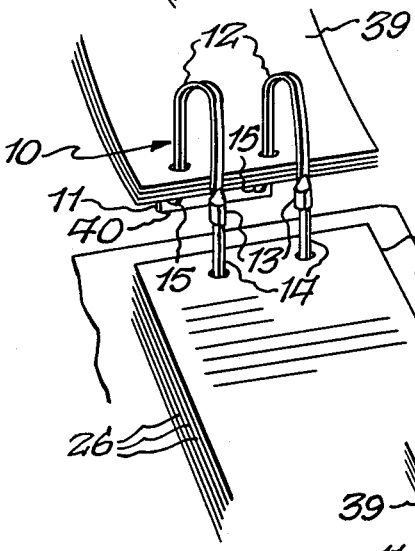
Fig. 12.
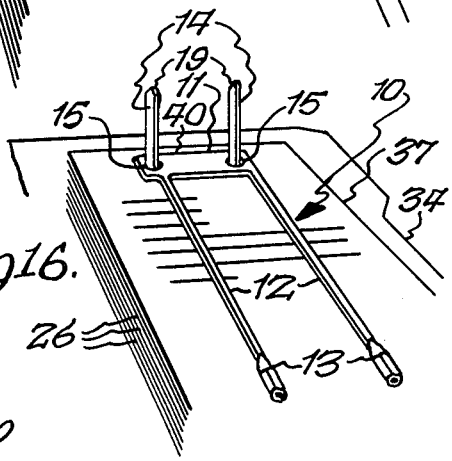
Fig. 16.
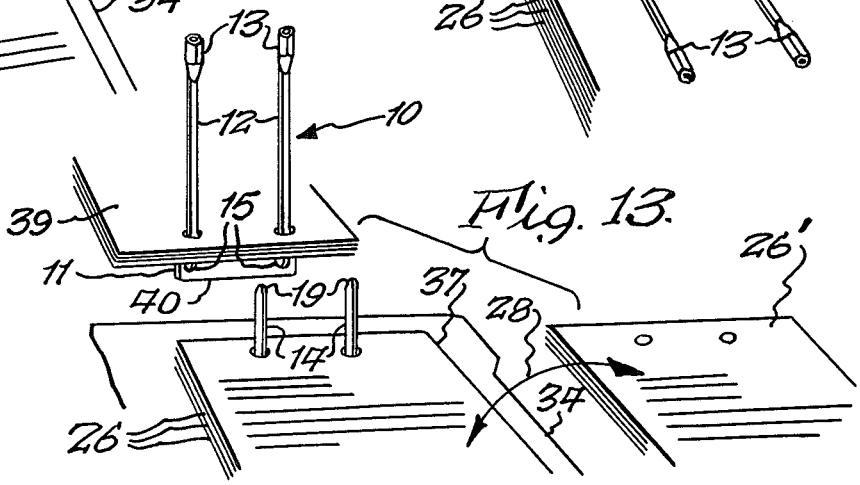
Fig. 13.

COMBINED SHEET COMPRESSOR AND TRANSFER DEVICE FOR ATTACHMENT TO SPACED PRONGS OF A FILE FOLDER FASTENER

BACKGROUND OF THE INVENTION

The present invention relates to a combined sheet compressor and transfer device for attachment to spaced prongs of a file folder fastener which extend through perforations in a stack of sheets in a file folder.

By way of background, file folders often mount spaced prongs which extend through perforations in a stack of sheets to hold them in assembled relationship. However, it is often required to remove the top sheets from the stack, transfer other sheets to or from the middle of the stack and thereafter replace the removed sheets. One example is to remove a sheet from the middle of the stack for copying purposes and thereafter return it to its position in the stack. In the past, a rigid U-shaped device having tubular end portions was used as a transfer device. The tubular end portions were temporarily mounted on the ends of specially preformed prongs, and upper sheets from the stack were transferred onto the U-shaped device, which was then removed from the prongs with the upper sheets mounted thereon. Thereafter, middle sheets could be added to or removed from the remaining sheets of the stack. The tubular end portions of the U-shaped device with the upper sheets thereon could then be reinstalled on the prongs, and the upper sheets could be transferred from the device to the prongs. The foregoing prior art rigid U-shaped device could only be used with prongs which were specially preformed to be received in its tubular end portions; it could not be used with the prongs of a standard file fastener. Furthermore, the prior art device provided only the transferring function. It did not provide a compressor function, nor did it have any arrangement for securing it to the file folder. Additionally, the sheets which were transferred thereto had to be manually supported during the transfer process.

SUMMARY OF THE INVENTION

It is one object of the present invention to provide a device for attachment to spaced prongs of a file folder fastener which extend through perforations in a stack of sheets to selectively function as a compressor or as a device for transferring said sheets to and from said prongs. A related object is to provide a device of the foregoing type which when installed on the stack of sheets to function as a compressor is readily accessible for its transferring function.

Another object of the present invention is to provide a transfer device for removing sheets from spaced flexible prongs of a file folder fastener and for remounting said sheets on the spaced prongs, the transfer device including elongated flexible legs which permit it to be bent rearwardly to permit its outer end to rest on a table surface which in turn permits sheets which are transferred onto the transfer device to also rest on the table surface, thereby facilitating the transferring process by obviating the necessity to support the transferred sheets manually.

A further object of the present invention is to provide an improved transfer device which can be used to remove sheets from spaced flexible prongs of a file folder fastener and which has an improved tubular arrangement for snuggly mounting on the outer ends of the prongs without creating catch points which might interfere with the transfer of sheets from the prongs to the transfer device.

Yet another object of the present invention is to provide a combined compressor and sheet transfer device which can be manufactured by a simple plastic molding process. Other objects and attendant advantages of the present invention will readily be perceived hereafter.

The present invention relates to a transfer device for receiving sheets having spaced perforations therein from spaced prongs which are located in said perforations and for remounting said sheets on said spaced prongs or on other spaced prongs comprising a cross member, a pair of spaced elongated substantially parallel flexible legs having first and second ends, means connecting said first ends to said cross member, and mounting means on said second ends for selective mounting on said spaced prongs to thereby permit said sheets to be moved from said spaced prongs onto said spaced legs and from said spaced legs onto said spaced prongs or onto said other spaced prongs, said flexibility of said legs permitting them to be bent rearwardly to permit sheets which were transferred onto said legs from said stack to rest on a supporting surface.

The present invention also relates to a combined sheet compressor and transfer device for mounting on spaced prongs extending through perforations in a stack of sheets when it functions as a compressor and for transferring said sheets to and from said spaced prongs when it functions as a transfer device comprising a plate, a plurality of spaced openings in said plate for receiving said prongs to permit said device to function as a compressor, a pair of spaced substantially parallel legs having first and second ends, means attaching said first ends to said plate, and mounting means on said second ends of said legs for mounting on said spaced prongs to permit said sheets to be transferred between said spaced prongs and said legs.

The various aspects of the present invention will be more readily understood when the following portions of the specification are read in conjunction with the accompanying drawings wherein:

BRIEF DESCRIPTION OF THE DRAWINGS

FIG. 10 is a fragmentary perspective view showing a plurality of sheets mounted on a file folder with the compressor portion of the present invention being pressed against the sheets by the folded-down prongs of the file folder fastener;

FIG. 11 is a fragmentary perspective view showing the tubular ends of the sheet transfer device mounted on the ends of the prongs which have been bent to an upright position;

FIG. 12 is fragmentary perspective view showing the top sheets of the stack transferred onto the transfer device which has been bent rearwardly;

FIG. 13 is a fragmentary perspective view showing the legs of the transfer device disconnected from the prongs to permit intermediate sheets to be inserted onto or removed from the remaining stack on the prongs;

FIG. 14 is a fragmentary perspective view showing the sheets being transferred back to the prongs of the file folder prior to the tubes being disconnected from the prongs;

FIG. 15 is a fragmentary perspective view showing the transfer device disconnected from the prongs; and FIG. 16 is a fragmentary perspective view showing the compressor portion of the combined device mounted on the prongs prior to the prongs being bent downwardly to the position of FIG. 10 to retain the combined device on top of the stack of sheets in the file.

DESCRIPTION OF THE PREFERRED EMBODIMENTS

The combined compressor and sheet transfer device 10 of the present invention is an integral molded plastic member, preferably polyethylene, which includes a cross member 11 which functions as a compressor and a pair of elongated flexible legs 12 connected to cross member 11 at their upper ends and mounting flexible tubular members 13 at their lower ends.

Figure 1:
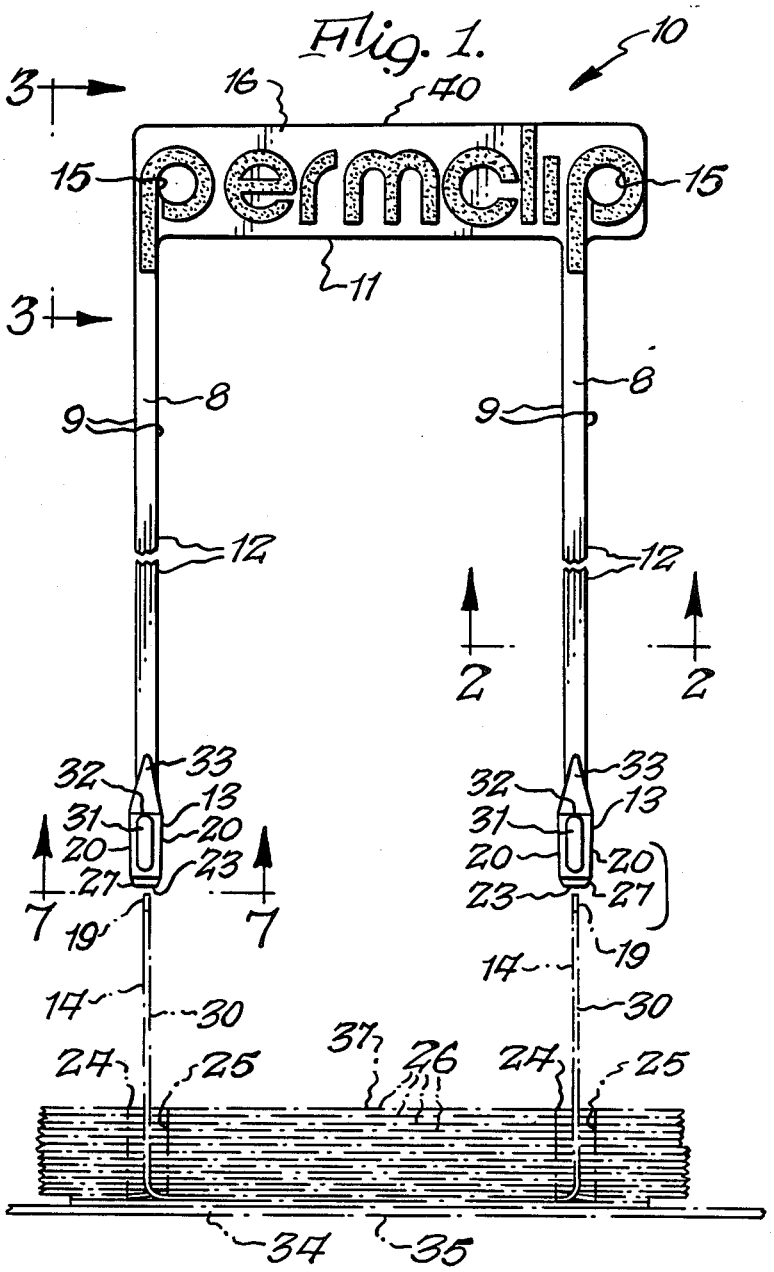
FIG. 1 is a fragmentary plan view of the combined compressor and sheet transfer device of the present invention shown relative to a phantom showing of a plurality of sheets mounted on a file folder by means of a pronged fastener in an extended upright position to receive the legs of the combined compressor and sheet transfer device.
Figure 3:
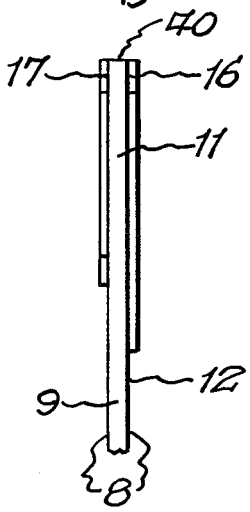
FIG. 3 is a fragmentary side elevational view taken substantially in the direction of arrows 3—3 of FIG. 1 and showing primarily the thickness of the compressor and leg portions of the device.
Figure 2:
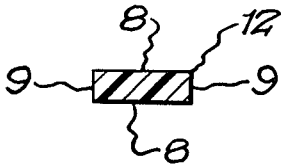
FIG. 2 is an enlarged cross sectional view taken substantially along line 2—2 of FIG. 1.
Figure 1A:
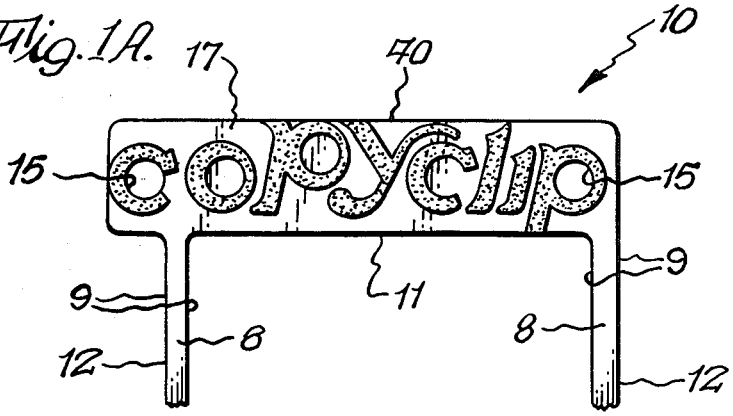
FIG. 1A is a fragmentary plan view of the rear of the device of FIG. 1.

Cross member 11 is in the form of a plate of rectangular cross section and on one surface it bears the trademark PERMCLIP in raised letters and on the other side it bears the trademark COPYCLIP in raised letters, both of which are the trademarks of Permclip Products Corporation. Flexible legs 12 (FIGS. 1 and 2) are of rectangular cross section with longer sides 8 and shorter sides 9, and legs lie in substantially the same plane with their longer sides 8 in substantial alignment. Plate 11 is the same thickness as side 9 of legs 12, namely, 1/16 of an inch, and the lettering, as noted above, is raised above this thickness. The reason for the rectangular cross sectional shape of legs 12 is so that when the device 10 is mounted on a stack of sheets and functioning as a compressor, the legs 12 will curl directly rearwardly without moving laterally to the side when the sheets are curled rearwardly when they are being lifted while still fastened to the file folder. If the legs were round, they would tend to move laterally rather than curling directly rearwardly.

When the device 10 functions as a compressor, the file folder prongs 14 extend through spaced apertures 15 in plate 11 and the prongs 14 bear down on the top surface of the plate (FIG. 10). In this respect, either side 16 or 17 of plate 11 can be considered the top surface, depending on which way the plate is laid onto the stack of sheets.

Figure 4:
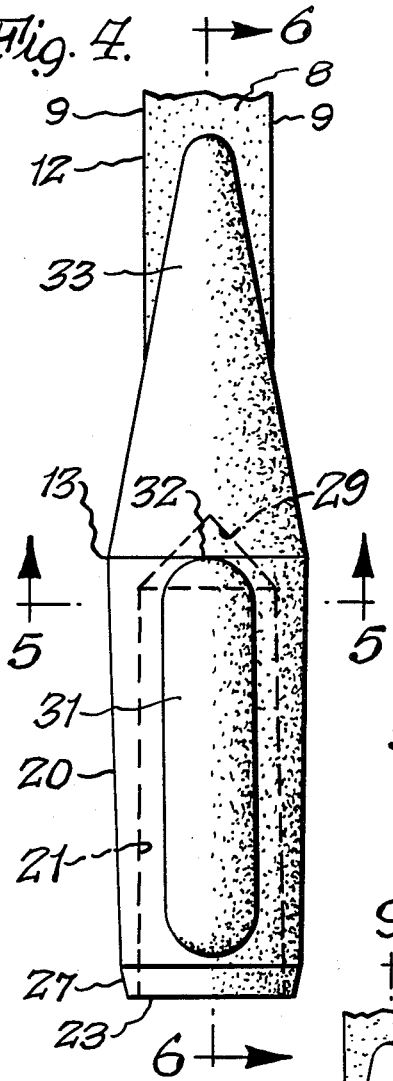
FIG. 4 is a fragmentary enlarged plan view of one of the tubular members at the ends of the legs for receiving the prongs of the file folder.
Figure 5:
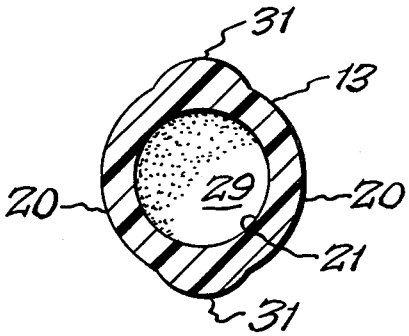
FIG. 5 is a cross sectional view taken substantially along line 5—5 of FIG. 4.
Figure 7:
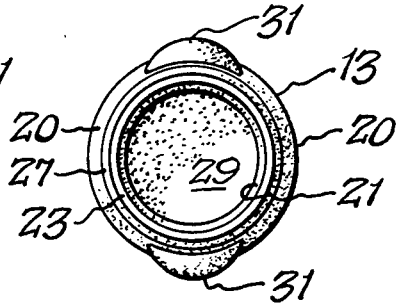
FIG. 7 is an end elevational view taken substantially in the direction of arrows 7—7 of FIG. 1.
Figure 8:
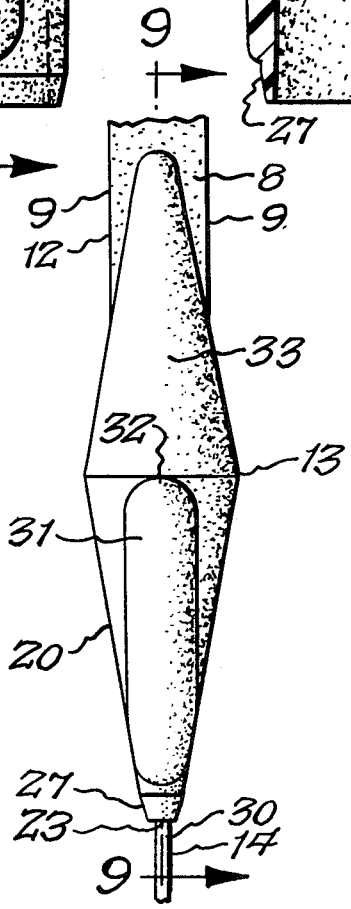
FIG. 8 is a fragmentary plan view of the manner in which the flexible tubes at the ends of the legs are distorted when they contain the outer ends of the prongs so as to provide a smooth junction therebetween so as not to catch on the edges of holes in the sheets moving upwardly.
Figure 9:
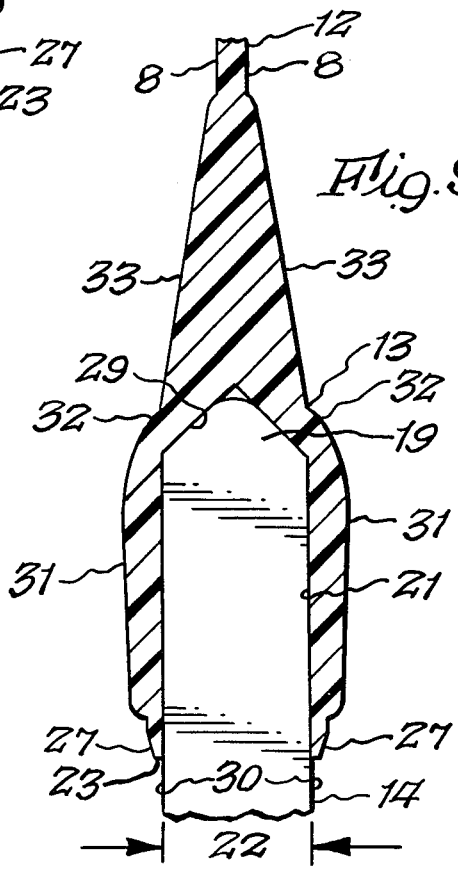
FIG. 9 is a fragmentary cross sectional view taken substantially along line 9—9 of FIG. 8 and showing the outer end of a file folder prong mounting the tube of the transfer device in which it is received.

When the device 10 is to function as a sheet transfer device, the flexible legs 12 are selectively mounted on the ends 19 of file folder prongs 14 by means of flexible tubular members 13 which include flexible wall portions 20 having a circular internal configuration 21 with a diameter which is normally less than the width dimension 22 of prongs 14 (FIG. 9). Thus when the prongs 14 are inserted into tubular members 13, the latter will distort to the condition shown in FIG. 8 wherein the sides of wall 20 are caused to converge downwardly so that the outer end portions 23 tend to fit reasonably tightly around prongs 14 and thus provide a relatively smooth junction therewith to prevent the edges 24 (FIG. 1) of perforations 25 in sheets 26 from catching on the outer ends 23 of members 13. The distortion also causes tubular members 13 to be snugly mounted on prongs 14 so that they can only be separated therefrom by a pulling force which is greater than the forces experienced during the transferring of sheets onto legs 12. To facilitate the movement of sheets 26 past ends 23, chamfers 27 are formed at the ends. To facilitate the foregoing convergence of wall 20, the outer surface of wall 20 is tapered toward the open end 23 when it is unstressed, as shown in FIGS. 4 and 5, and the wall 20 itself is tapered. In the foregoing respects, the outer end of wall 20 proximate its junction with chamfer 27 has a thickness of about 0.015 inches and the inner end of wall 20, where it joins conical bore 29, has a thickness of about 0.025 inches; and the outer diameter of tubular member 13 at lead line 13 of FIG. 4 is 0.200 inches and its outer diameter at the junction with chamfer 27 is 0.180 inches.

The end portions 19 of prongs 14 enter opening 21 of each tubular member 13, and they can move therein until they abut conical end wall 29. Reinforcement bosses 31 are integrally formed on diametrically opposite sides of tubular members 13 to prevent sharp edges 30 of prongs 14 from cutting through members 13 while permitting the remainder of walls 20 to be relatively thin and flexible. The ends 32 of bosses 31 are rounded so as not to provide catch points on the edges 24 of perforations 25 of sheets 26. The inner ends 33 of tubular members 13 are tapered as shown in the drawings to provide smooth junctions between legs 12 and tubes 13, thus precluding the edges 24 of perforations 25 from catching on tubes 13 when they pass onto tubes 13 from legs 12.

Figure 6:
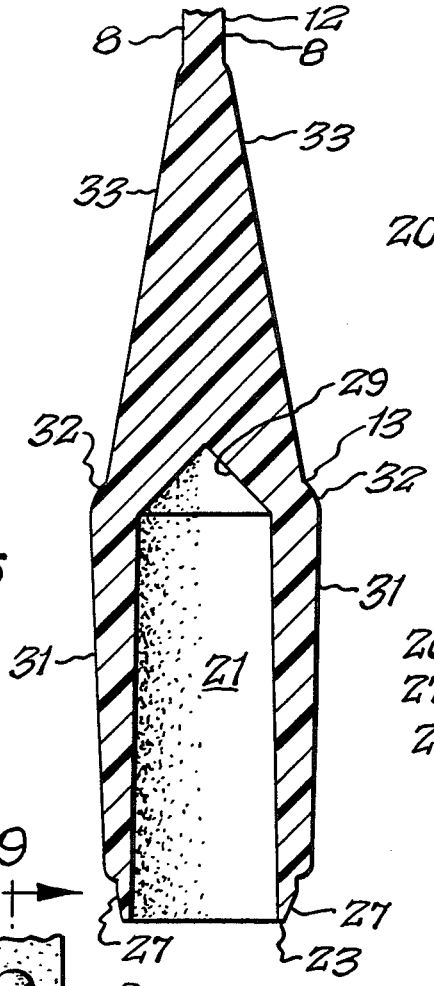
FIG. 6 is a cross sectional view taken substantially along line 6—6 of FIG. 4.

The tubes 13, by way of example, have an internal diameter of about 0.150 inches at their outer ends so as to provide an interference fit with all types of fastener prongs which are a standard 7/32 of an inch wide and 0.010–0.014 inches thick. Furthermore, as can be seen from FIG. 6, the bore 21 has a draft therein so that its inner end is smaller than its outer end, to thereby provide a good tight fit with the outer end 19 of prong 14.

The combined paper compressor and sheet transfer device is intended to function as graphically shown in FIGS. 10–16. Normally the device 10 is mounted (FIG. 10) with prongs 14 extending through holes 15 and prongs 14 pressing downwardly on the top surface of plate 11. Thus a dual function is obtained, namely, plate 11 functions as a compressor and also serves to attach the device 10 to the sheets mounted on file folder 34 so that it is readily accessible when sheets 26 are to be transferred. If it were not attached, it could be hidden within the file folder or lost. Furthermore, since the device 10 is relatively flat, it will take up practically no space in the file folder 34, which may be of any conventional type having a rear sheet 35 to which the sheets 26 are attached and which may also have a front sheet which covers the sheets 26. At this point it is to be noted that the prongs 14 may be attached to rear sheet 35 in any conventional manner as by extending through perforations in rear sheet 35 in the well-known manner, or the prongs 14 may be adhesively attached to the file folder, the latter being shown and described in U.S. Pat. Nos. 3,867,743 and 4,285,104.

When it is desired to transfer sheets to or from stack 37, it is merely necessary to bend prongs 14 to the upright position shown in FIG. 11 and mount tubes 13 on the outer ends thereof as described previously. Thereafter, the top sheets of stack 37 are moved over tubes 13 and onto legs 12 which can be bent rearwardly as shown. Legs 12 are preferably about 7 inches long so that the top edge 40 of plate 11 can rest on a table top on which rear sheet 34 of file folder 35 is resting so that the sheets 39 which have been transferred onto legs 12 can rest on the table top, thereby precluding the necessity for manually holding the sheets above the table top. Furthermore, when plate 11 rests on the table top, the transfer process is much neater than if it was located above the table top. However, it is to be understood that legs 12 could be shorter if desired so that cross member 11 does not rest on the table top, if the foregoing advantage is eliminated.

After the top sheets 39 have been transferred onto legs 12, tubes 13 are removed from prongs 14, as shown in FIG. 13. When upper edge 40 of plate 11 is in engagement with the table top, both hands can be used to demount tubes 13 from prongs 14 without holding upper sheets 39 because they are already resting on the table top. After tubes 13 have been demounted, sheets 26' can be removed from prongs 14 or new sheets can be mounted on prongs 14, as depicted by arrows 28, while sheets 39 remain assembled on legs 12. Thereafter, tubes 13 are remounted on prongs 14 and the top sheets 39 are slid onto prongs 14 from legs 12, as depicted by arrow 38, after which tubes 13 are removed from prongs 14 as shown in FIG. 15. Thereafter, prongs 14 are inserted through holes 15 in plate 11 and prongs 14 are bent downwardly as shown in FIG. 16 until they assume a flattened condition as shown in FIG. 10 wherein plate 11 not only performs its compressor function, but also is physically attached to the file folder for ready access.

While the foregoing description has shown the transfer device used to transfer sheets to and from a given set of prongs, it will be appreciated that it can be used to transfer sheets from one set of prongs to another set of prongs.

It is to be understood that certain claims intend to cover the concept of a combined compressor and sheet transfer device, and certain of these claims are not limited to legs 12 being flexible, as they need not be flexible if only the combined function is intended to be achieved without the advantage of flexibility of the legs as discussed in detail above. Furthermore, certain claims are directed only to the transfer device per se, and as such the cross member recited therein need not be of plate form as shown, but may be of any other configuration, such as a narrow bar. In the latter instance, a loop may be formed integrally with the narrow bar so that the transfer device can be attached to a prong so that it is readily accessible.

While the preceding description has referred to a pronged fastener associated with a file folder, it will be appreciated that in certain instances pronged fasteners are used by themselves to maintain sheets in assembled relationship, and the present combined compressor and transfer device is equally usable with this type of device. Furthermore, while dimensions have been set forth in preceding portions of the specification, it will be appreciated that they are by way of example and not of limitation.

In the foregoing portion of the specification, the tubular members 13 were described as having flexible wall portions which were capable of distortion. However, it is also within the contemplation of the present invention that tubular members 13 could be molded as substantially rigid members in the configuration shown in FIG. 8, with or without the bosses 31.

Figure 17:
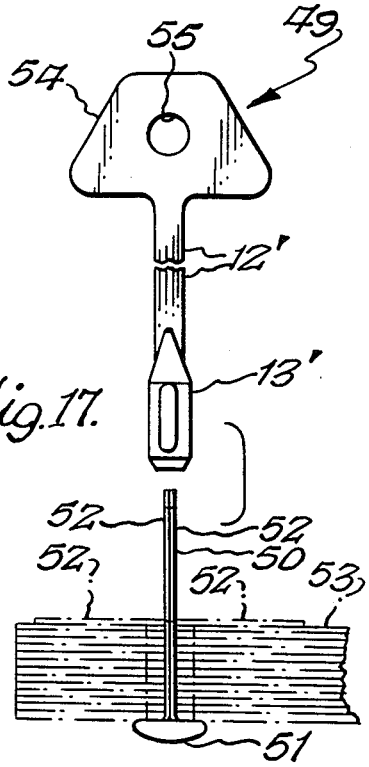

In FIG. 17 an alternate transfer device 49 is disclosed for use with a single paper fastener 50 consisting of a button-like head 51 from which a pair of prongs 52 extend through holes in a stack of sheets 53. The prongs 52 are bent downwardly to a dotted-line position to lie on the top sheet and thus hold the stack in assembled relationship. A single fastener 50 is normally located in the corner of a stack of sheets.

Transfer device 49 includes a tubular member 13' which is identical to tubular member 13 described above and which receives prongs 52 when the latter are bent upwardly to a solid-line position. The upper portion of tubular member 13' merges into flexible leg 12' which may be identical to leg 12 described above, or which may be of any desired cross-sectional configuration. The upper end of leg 12' merges into cross member 54 which prevents sheets transferred onto leg 12' from falling off of the upper end thereof. A hole 55 is located in cross member 54 so that it can be mounted on prongs 52 before they are bent downwardly to their dotted-line positions. Thus cross member 54 functions somewhat as a compressor.

It will be appreciated that tubular member 13' has to be dimensioned relative to prongs 52 so that an action is obtained which is the same as depicted in FIGS. 8 and 9. Alternatively, tubular member 13' should have an outer diameter which permits it to be inserted into the holes in the stack of sheets, and this can be done when the width of prongs 52 is much less than the diameter of the holes in the sheets. Furthermore, the bosses, such as 31 of the preceding figures, may be eliminated because fasteners such as 50 do not have sharp edges. The thickness of legs 12' and cross member 54 of transfer device 49 may be the same as described above for analogous parts of device 10.

While preferred embodiments of the present invention have been disclosed, it will be appreciated that the present invention is not limited thereto, but may be otherwise embodied within the scope of the following claims.

What is claimed is:

1. A transfer device for receiving sheets having spaced perforations therein from spaced prongs which are located in the perforations and for remounting the sheets on the spaced prongs or on other spaced prongs comprising a pair of spaced elongated substantially parallel legs having first and second ends, means connecting said first ends to each other, mounting means on said second ends for selective mounting on the spaced prongs to thereby permit the sheets to be moved from the spaced prongs onto said spaced legs and from said spaced legs onto the spaced prongs or onto other spaced prongs, and attachment means for attaching said transfer device to at least one of the prongs when said mounting means are not mounted on the prongs.

2. A combined sheet compressor and transfer device for mounting on spaced prongs extending through perforations in a stack of sheets when it functions as a compressor and for transferring the sheets to and from the spaced prongs when it functions as a transfer device comprising a plate, a plurality of spaced openings in said plate for receiving the prongs to permit said device to function as a compressor, a pair of spaced substantially parallel legs having first and second ends, means attaching said first ends to said plate, and mounting means on said second ends of said legs for mounting on the spaced prongs to permit the sheets to be transferred between the spaced prongs and said legs.

3. A combined sheet compressor and transfer device as set forth in claim 2 wherein each of said mounting means comprise a flexible tubular member.

4. A combined sheet compressor and transfer device as set forth in claim 3 wherein each of said flexible tubular members has an inner end and an outer end and an internal diameter which is less than the width of said prongs to thereby cause each of said tubular members to distort so that said outer ends tend to conform to the prongs to thereby provide a relatively smooth junction therebetween to facilitate the movement of sheets from the spaced prongs onto said legs.

5. A combined sheet compressor and transfer device as set forth in claim 4 including tapered lead-in portions at the junctions of said second ends of said legs and said inner ends of said tubular members to facilitate movement of sheets from said legs onto said tubular members.

6. A combined sheet compressor and transfer device as set forth in claim 4 including a pair of diametrically opposed elongated reinforcements on the outside of each of said tubular members for reinforcing said tubular members against being cut by the edges of the spaced prongs.

7. A combined sheet compressor and transfer device as set forth in claim 6 including tapered lead-in portions at the junctions of said second ends of said legs and said inner ends of said tubular members to facilitate movement of sheets from said legs onto said tubular members.

8. A combined sheet compressor and transfer device as set forth in claim 7 wherein all of the aforestated parts of said combined sheet compressor and transfer device are fabricated in a single piece of plastic, and wherein said legs are flexible and of substantially rectangular cross section.

9. A transfer device for receiving sheets each having a perforation therein from prong means which is located in each of the perforations comprising a single elongated leg having first and second ends, a cross member at said first end, and mounting means on said second end for selective mounting on the prong means to thereby permit the sheets to be moved from the prong means onto said single elongated leg and from said single elongated leg onto the prong means, said mounting means comprising a tubular member, said tubular member being flexible and having an inner end and an outer end and an internal diameter which is less than the width of the prong means to thereby cause said tubular member to distort so that its outer end tends to conform to the prong means to thereby provide a relatively smooth junction therewith to facilitate the movement of the sheets onto said leg, and a tapered lead-in portion at the junction of said second end of said leg and said tubular member to facilitate the movement of the sheets from said leg onto the prong means, said outer end of said tubular member being chamfered.

10. A transfer device as set forth in claim 9 wherein said elongated leg is flexible.

11. A transfer device as set forth in claim 9 wherein said cross member essentially forms a T with said elongated leg.

12. A transfer device as set forth in claim 9 wherein said tubular member has a wall thickness which tapers toward said outer end.

13. A transfer device as set forth in claim 9 wherein said tubular member has an outer configuration which tapers toward said outer end.

14. A transfer device for receiving sheets each having a perforation therein from prong means which is located in each of the perforations comprising a single elongated leg having first and second ends, a cross member at said first end, and mounting means on said second end for selective mounting on the prong means to thereby permit the sheets to be moved from the prong means onto said single elongated leg and from said single elongated leg onto the prong means, said mounting means comprising a tubular member, said tubular member being flexible and having an inner end and an outer end and an internal diameter which is less than the width of the prong means to thereby cause said tubular member to distort so that its outer end tends to conform to the prong means to thereby provide a relatively smooth junction therewith to facilitate the movement of the sheets onto said leg, and a pair of diametrically opposed elongated reinforcement means on the outside of said tubular member for reinforcing said tubular member against being cut by the edges of the prong means.

15. A transfer device as set forth in claim 14 including a tapered lead-in portion at the junction of said second end of said leg and said tubular member to facilitate the movement of the sheets from said leg onto the prong means.

16. A transfer device as set forth in claim 14 wherein said tubular member has an outer configuration which tapers toward said outer end.

17. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, and mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, said spaced substantially parallel flexible legs being substantially rectangular in cross section with their longer dimensions substantially in line with each other.

18. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, said cross member comprising a substantially flat plate, and a pair of spaced holes in said cross member for mounting said cross member on the spaced prongs to thereby cause said cross member to also function as a compressor.

19. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, and mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, said cross member comprising a substantially flat plate, said spaced substantially parallel flexible legs being substantially rectangular in cross section with their longer dimensions substantially in line with each other, and a pair of spaced holes in said cross member for mounting said cross member on the spaced prongs to thereby cause said cross member to also function as a compressor.

20. A transfer device as set forth in claim 19 wherein each of said mounting means comprise a tubular member.

21. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, and mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, each of said mounting means comprising a tubular member, each of said tubular members being flexible and having an inner end and an outer end and an internal diameter which is less than the width of the spaced prongs or the other spaced prongs to thereby cause each of said tubular members to distort so that said outer ends tend to conform to the spaced prongs or the other spaced prongs to thereby provide a relatively smooth junction therebetween to facilitate the movement of the sheets onto said legs.

22. A transfer device as set forth in claim 21 including tapered lead-in portions at the junctions of said second ends of said legs and said inner ends of said tubular members to facilitate movement of sheets from said flexible legs onto said tubular members.

23. A transfer device as set forth in claim 22 wherein said outer ends of said tubular members are chamfered.

24. A transfer device as set forth in claim 21 wherein each of said tubular members has an outer configuration which tapers toward said outer end.

25. A transfer device as set forth in claim 21 wherein each of said tubular members has a wall thickness which tapers toward said outer end.

26. A transfer device as set forth in claim 25 wherein each of said tubular members has an outer configuration which tapers toward said outer end.

27. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, and mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, each of said mounting means comprising a tubular member, each of said tubular members being flexible and having an inner end and an outer end and an internal diameter which is less than the width of the spaced prongs or the other spaced prongs to thereby cause each of said tubular members to distort so that said outer ends tend to conform to the spaced prongs or the other spaced prongs to thereby provide a relatively smooth junction therebetween to facilitate the movement of the sheets onto said legs, and a pair of diametrically opposed elongated reinforcement means on the outside of each of said tubular members for reinforcing said tubular members against being cut by the edges of the spaced prongs or the other spaced prongs.

28. A transfer device as set forth in claim 27 wherein said outer ends of said tubular members are chamfered.

29. A transfer device as set forth in claim 28 including tapered lead-in portions at the junctions of said second ends of said legs and said inner ends of said tubular members to facilitate movement of sheets from said flexible legs onto said tubular members.

30. A transfer device for receiving sheets having spaced perforations therein from spaced prongs which are located in the perforations and for remounting the sheets on the spaced prongs or on other spaced prongs comprising a cross member, a pair of spaced elongated substantially parallel flexible legs having first and second ends, means connecting said first ends to said cross member, and mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, each of said mounting means comprise a tubular member, each of said tubular members being flexible and having an inner end and an outer end and an internal diameter which is less than the width of the spaced prongs or the other spaced prongs to thereby cause each of said tubular members to distort so that said outer ends tend to conform to the spaced prongs or the other spaced prongs to thereby provide a relatively smooth junction therebetween to facilitate the movement of the sheets onto said legs, each of said tubular members having a wall thickness which tapers toward said outer end, and a pair of diametrically opposed elongated reinforcement means on the outside of each of said tubular members for reinforcing said tubular members against being cut by the edges of the spaced prongs or the other spaced prongs.

31. A transfer device as set forth in claim 30 including tapered lead-in portions at the junction of said second ends of said legs and said inner ends of said tubular members to facilitate movement of sheets from said flexible legs onto said tubular members.

32. A transfer device as set forth in claim 30 wherein said outer ends of said tubular members are chamfered.

33. A transfer device for receiving sheets having spaced perforations therein from spaced prongs which are located in the perforations and for remounting the sheets on the spaced prongs or on other spaced prongs comprising a pair of spaced elongated substantially parallel flexible legs having first and second ends, means connecting said first ends to each other, mounting means on said second ends for selective mounting on the spaced prongs to thereby permit the sheets to be moved from the spaced prongs onto said spaced legs and from said spaced legs onto the spaced prongs or onto other spaced prongs, said flexibility of said legs permitting them to be bent rearwardly to permit sheets which were transferred onto said legs from the spaced prongs to rest on a supporting surface, and attachment means for attaching said transfer device to at least one of the prongs when said mounting means are not mounted on the prongs.

34. A transfer device as set forth in claim 33 wherein said attachment means comprise a pair of spaced holes in said cross member for mounting said cross member on the spaced prongs.

35. A transfer device for receiving sheets having spaced perforations therein from spaced flat strip-like prongs which are located in the perforations and for remounting the sheets on the spaced flat strip-like prongs or on other spaced flat strip-like prongs comprising a pair of spaced elongated substantially parallel legs having first and second ends, means connecting said first ends to each other, and mounting means on said second ends for selective mounting on the spaced flat strip-like prongs to thereby permit the sheets to be moved from the spaced flat strip-like prongs onto said spaced legs and from said spaced legs onto the spaced flat strip-like prongs or onto other spaced flat strip-like prongs, each of said mounting means comprising a tubular member, each of said tubular members being flexible and having an inner end and an outer end and an internal diameter which is less than the width of the spaced flat strip-like prongs or the other spaced flat strip-like prongs to thereby cause each of said tubular members to distort so that said outer ends tend to conform to the spaced flat strip-like prongs or the other spaced flat strip-like prongs when mounted thereon to thereby provide a relatively smooth junction therebetween to facilitate the movement of the sheets onto said legs.

36. A transfer device as set forth in claim 35 including tapered lead-in portions at the junctions of said second ends of said legs and said inner ends of said tubular members to facilitate movement of sheets from said legs onto said tubular members.

37. A transfer device as set forth in claim 36 including a pair of diametrically opposed elongated reinforcements on the outside of each of said tubular members for reinforcing said tubular members against being cut by the edges of the spaced flat strip-like prongs.

38. A transfer device as set forth in claim 36 wherein said outer ends of said tubular members are chamfered.

39. A transfer device as set forth in claim 35 wherein each of said tubular members has a wall thickness which tapers toward said outer end.

40. A transfer device as set forth in claim 35 including attachment means for attaching said transfer device to at least one of the flat strip-like prongs when said mounting means are not mounted on the flat strip-like prongs.

41. A combined sheet compressor and transfer device for mounting on spaced prongs extending through perforations in a stack of sheets when it functions as a compressor and for transferring the sheets to and from the spaced prongs when it functions as a transfer device comprising means for bearing on the stack of sheets, means on said last-mentioned means for receiving the prongs to permit said device to function as a compressor, a pair of spaced substantially parallel legs having first and second ends, means attaching said first ends to said means for bearing on the stack of sheets, and mounting means on said second ends of said legs for mounting on the spaced prongs to permit the sheets to be transferred between the spaced prongs and said legs.

42. A combined sheet compressor and transfer device as set forth in claim 41 wherein said means for receiving the prongs comprise holes in said means for bearing on the stack of sheets.

43. A combined sheet compressor and transfer device as set forth in claim 42 wherein said legs are substantially rectangular in cross section.

44. A combined sheet compressor and transfer device as set forth in claim 41 wherein said legs are flexible.

* * * * *

UNITED STATES PATENT AND TRADEMARK OFFICE

CERTIFICATE OF CORRECTION

PATENT NO. : 4,869,613

DATED : September 26, 1989

INVENTOR(S) : Thomas J. Corey

It is certified that error appears in the above-identified patent and that said Letters Patent is hereby corrected as shown below:

Column 3, line 56, before "legs" insert --the--.

Column 11, line 23 (claim 32), change "30" to --31--.

Signed and Sealed this

Fourteenth Day of August, 1990

*Attest:*

HARRY F. MANBECK, JR.

*Attesting Officer*

*Commissioner of Patents and Trademarks*